US009234486B2

(12) United States Patent
Das et al.

(10) Patent No.: US 9,234,486 B2
(45) Date of Patent: Jan. 12, 2016

(54) METHOD AND SYSTEMS FOR A LEAKAGE PASSAGEWAY OF A FUEL INJECTOR

(71) Applicant: General Electric Company, Schenectady, NY (US)

(72) Inventors: Sumit Kumar Das, Erie, PA (US); Paul Gerard Nistler, Erie, PA (US); Javier Rivera, Erie, PA (US); Muthu Anandhan, Erie, PA (US)

(73) Assignee: General Electric Company, Schenectady, NY (US)

( * ) Notice: Subject to any disclaimer, the term of this patent is extended or adjusted under 35 U.S.C. 154(b) by 387 days.

(21) Appl. No.: 13/967,490

(22) Filed: Aug. 15, 2013

(65) Prior Publication Data

US 2015/0047612 A1 Feb. 19, 2015

(51) Int. Cl.

| | |
|---|---|
| ***F02M 55/00*** | (2006.01) |
| ***F02M 63/00*** | (2006.01) |
| ***F02M 55/02*** | (2006.01) |

(52) U.S. Cl.

CPC ..... *F02M 55/002* (2013.01); *F02M 55/025* (2013.01); *F02M 63/0054* (2013.01); *F02M 2200/31* (2013.01); *F02M 2200/40* (2013.01)

(58) Field of Classification Search

CPC ... F02M 55/00; F02M 55/002; F02M 55/025; F02M 63/0054; F02M 2200/31; F02M 2200/40; F02M 37/04; F02M 63/00; F02M 63/0215

See application file for complete search history.

(56) References Cited

U.S. PATENT DOCUMENTS

| | | | | |
|---|---|---|---|---|
| 6,758,415 | B2 * | 7/2004 | Fischer | F02M 47/027 239/533.2 |
| 7,025,045 | B2 * | 4/2006 | Hlousek | F02M 47/027 123/447 |
| 8,196,564 | B2 * | 6/2012 | Borchsenius | F02D 41/3845 123/447 |
| 9,038,601 | B2 * | 5/2015 | Morris | F02M 63/0215 123/467 |
| 2004/0021008 | A1 | 2/2004 | Fischer et al. | |
| 2013/0104853 | A1 | 5/2013 | Morris et al. | |

* cited by examiner

*Primary Examiner* — Hieu T Vo
(74) *Attorney, Agent, or Firm* — GE Global Patent Operation; John A. Kramer

(57) ABSTRACT

Various methods and systems are provided for a leakage passageway for a fuel injector of a common rail fuel system. In one embodiment, a fuel injector for an engine comprises an injector accumulator, an injector flow limiter valve configured to control a flow of fuel from a common fuel rail and into the injector accumulator, and a leakage passageway coupled between the injector accumulator and an inlet of the injector flow limiter valve, the leakage passageway bypassing the injector flow limiter valve.

20 Claims, 7 Drawing Sheets

METHOD AND SYSTEMS FOR A LEAKAGE PASSAGEWAY OF A FUEL INJECTOR

FIELD

Embodiments of the subject matter disclosed herein relate to methods and systems for fuel injectors of a common rail fuel system in an engine.

BACKGROUND

In some vehicles, fuel is provided to a diesel engine by a common rail fuel system. In the common fuel rail system, fuel injectors inject fuel from the common fuel rail to cylinders of the engine for combustion. In some examples, the common fuel rail system may include a large accumulator coupled to all the fuel injectors. In other examples, each fuel injector may have a smaller injector accumulator. Further, fuel flowing to each fuel injector may be regulated by a flow limiter valve to reduce over-fueling. During an injection event at one fuel injector, the flow limiter valves corresponding to the other fuel injectors may be closed, thereby closing off the fuel volume of the non-injecting fuel injectors from the common fuel rail. As a result, the total common rail fuel volume may be reduced, thereby resulting in larger pressure fluctuations in the common rail. As a result of the larger pressure fluctuations, components of the common fuel rail system may degrade more quickly over time.

BRIEF DESCRIPTION

In one embodiment, a fuel injector for an engine comprises an injector accumulator, an injector flow limiter valve configured to control a flow of fuel from a common fuel rail and into the injector accumulator, and a leakage passageway coupled between the injector accumulator and an inlet of the injector flow limiter valve, the leakage passageway bypassing the injector flow limiter valve.

In this way, the leakage passageway provides fluid communication between the injector accumulator and the common fuel rail. As a result, the total common rail fuel volume increases, thereby decreasing fuel rail pressure fluctuations during engine operation. As a result, degradation of the common fuel rail system components may decrease.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

The present invention will be better understood from reading the following description of non-limiting embodiments, with reference to the attached drawings, wherein below.

DETAILED DESCRIPTION

Figure 1:
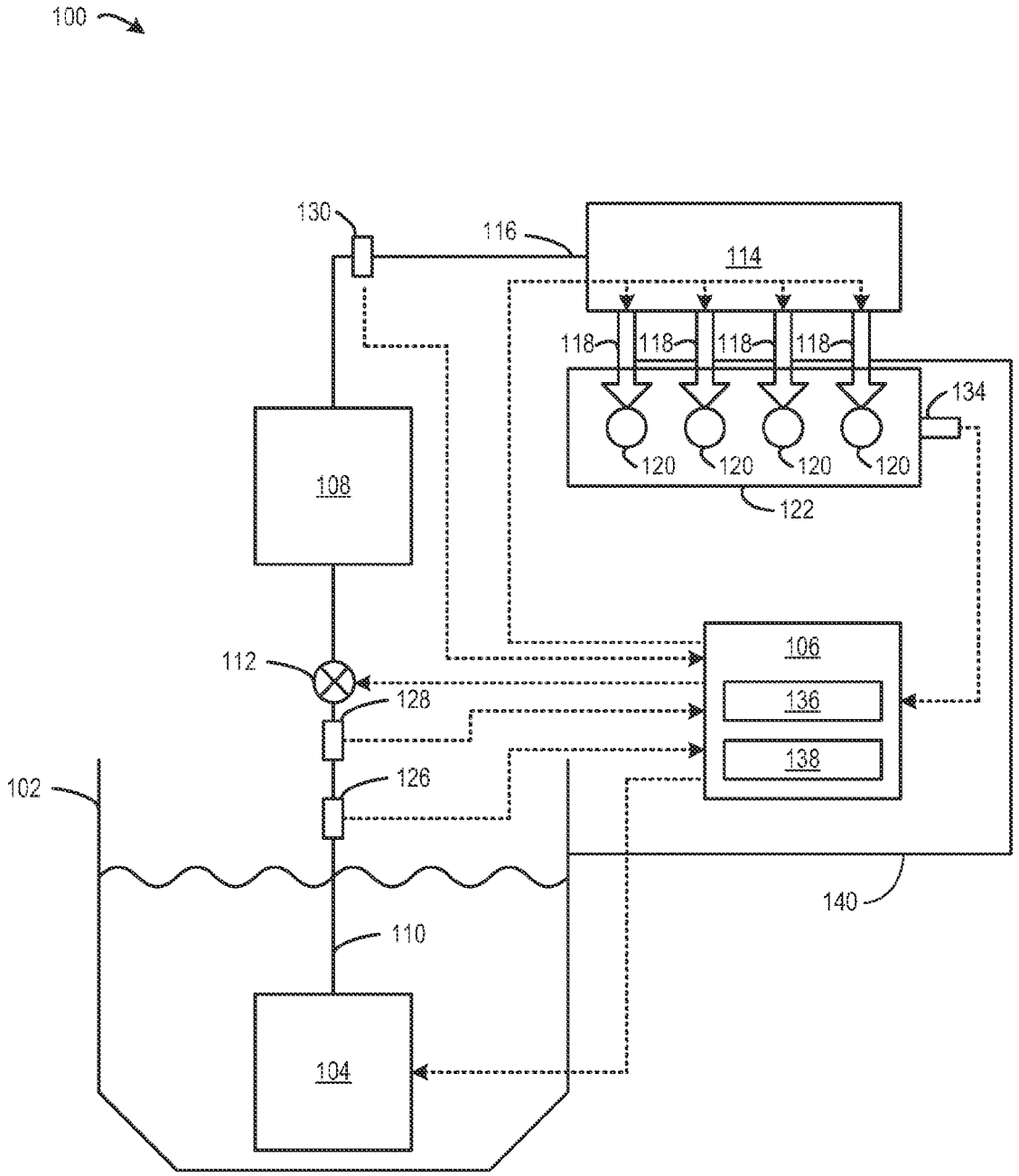
FIG. 1 shows a schematic diagram of a common fuel rail system according to an embodiment of the invention.
Figure 2:
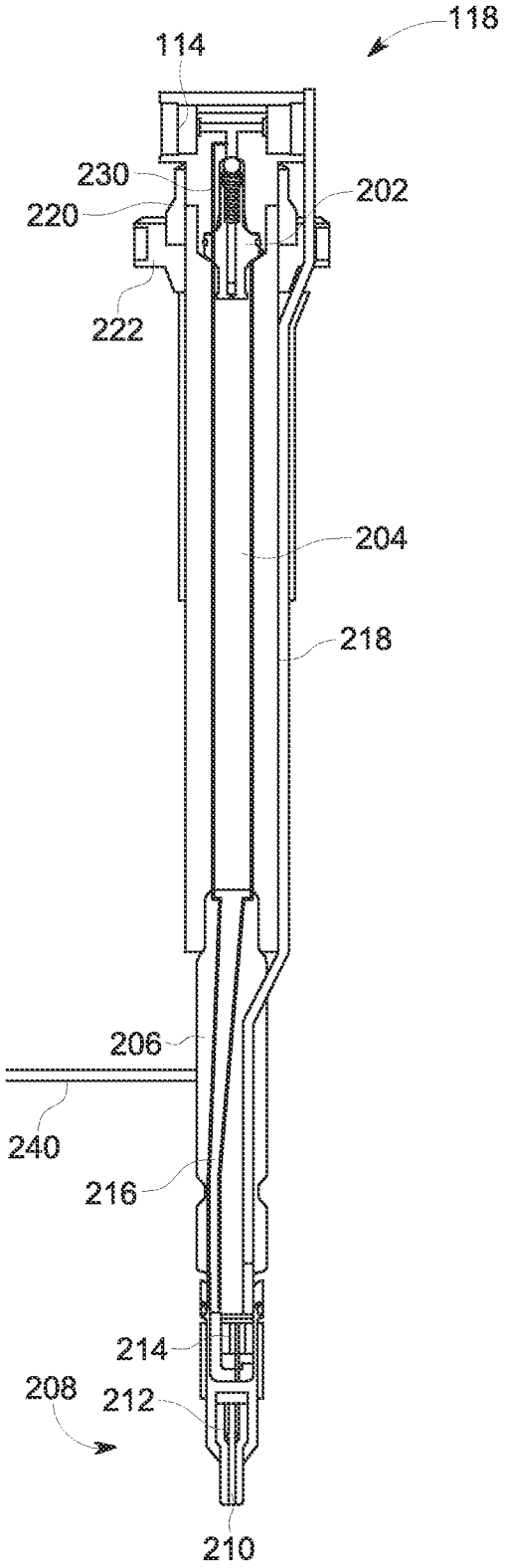
FIGS. 2-3 show an example fuel injector according to an embodiment of the invention
Figure 3:
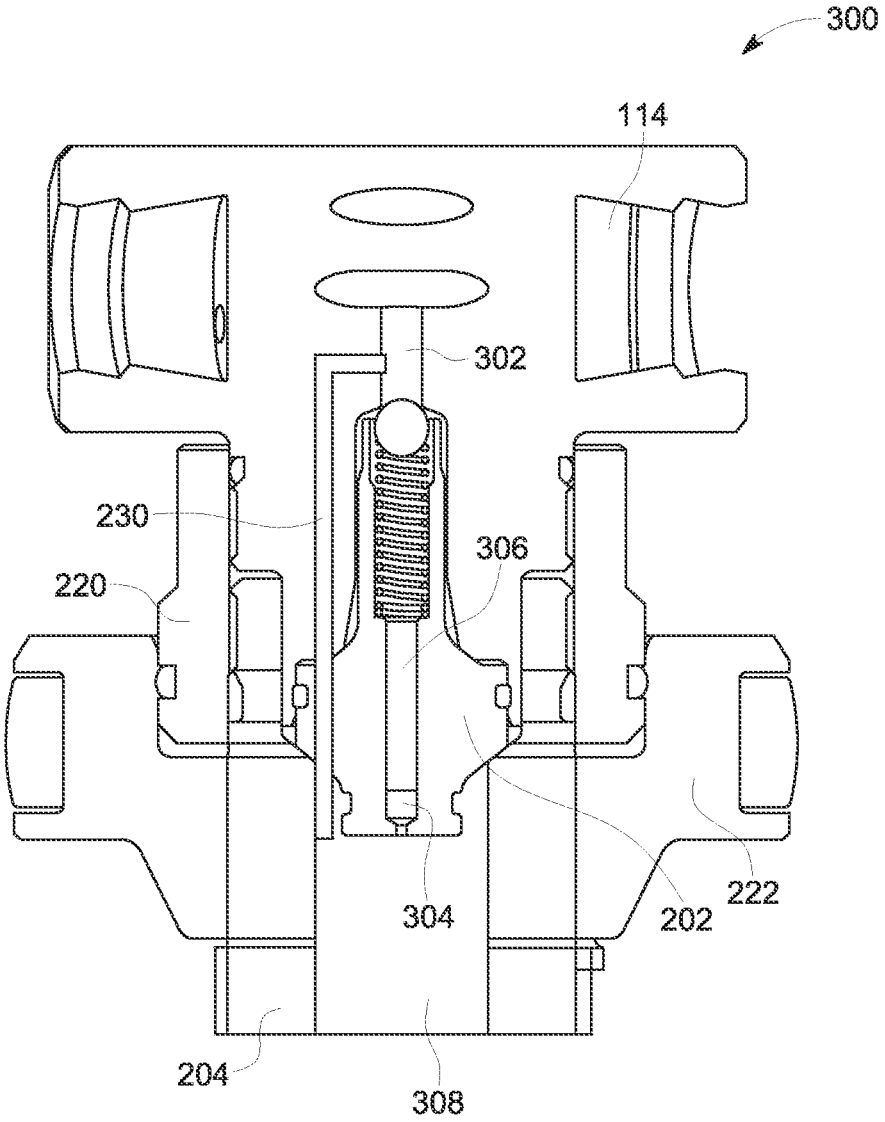
Figure 4:
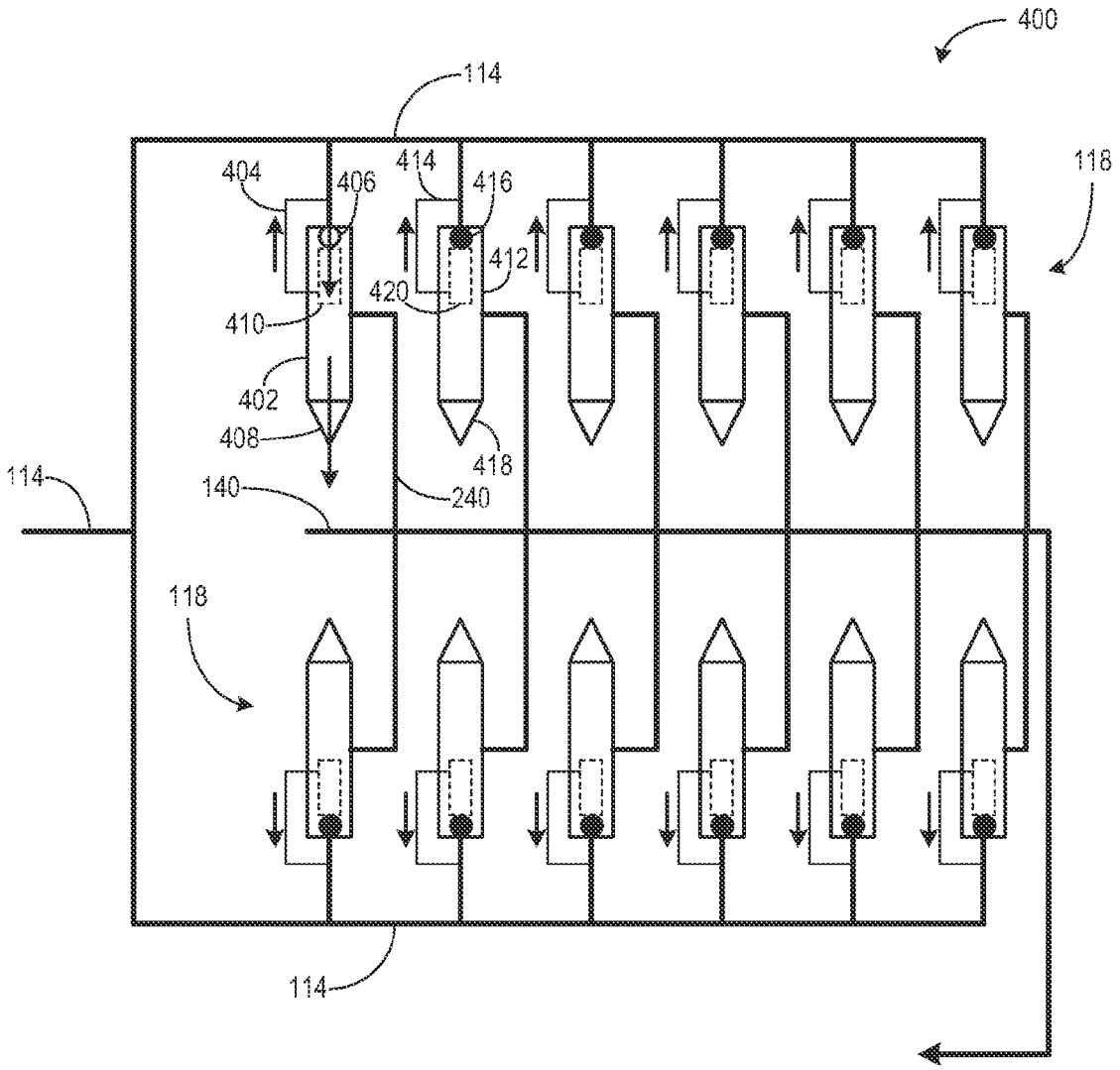
FIG. 4 shows an example fuel injection event for a common rail fuel system according to an embodiment of the invention.
Figure 5:
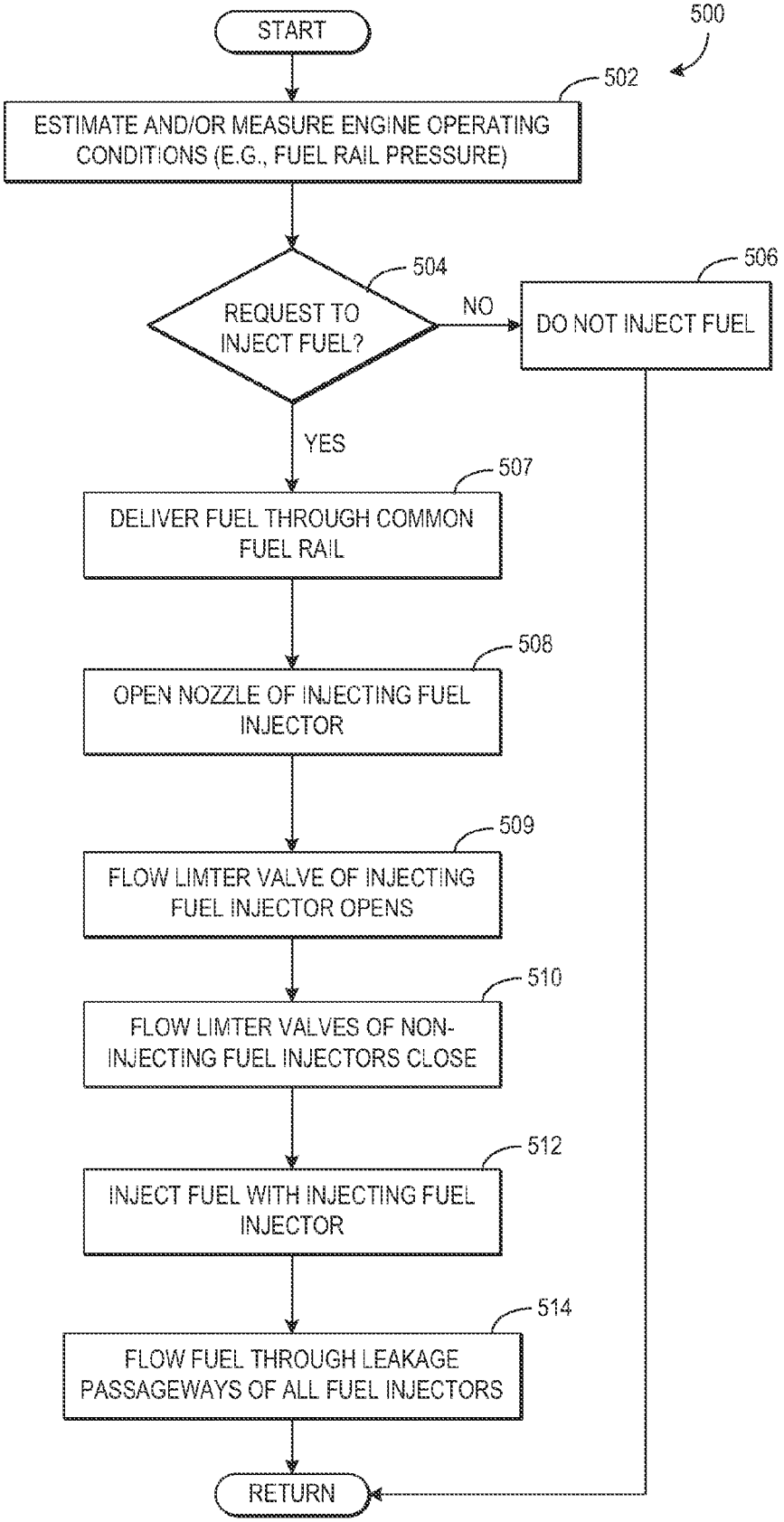
FIG. 5 shows an example method for operating fuel injectors during injection events according to an embodiment of the invention.
Figure 6:
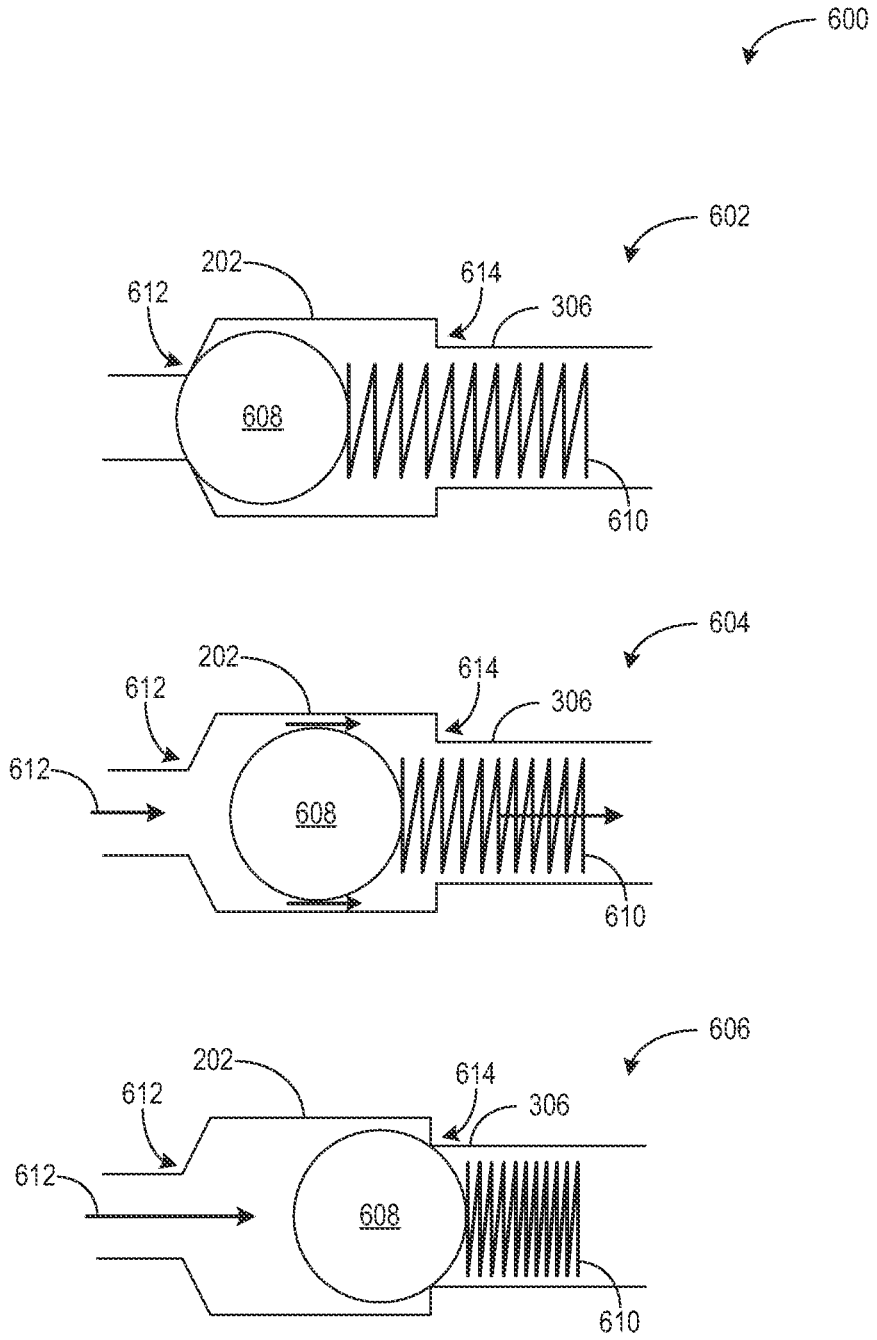
FIG. 6 shows example positions of a passive ball and spring type flow limiter valve according to an embodiment of the invention.
Figure 7:
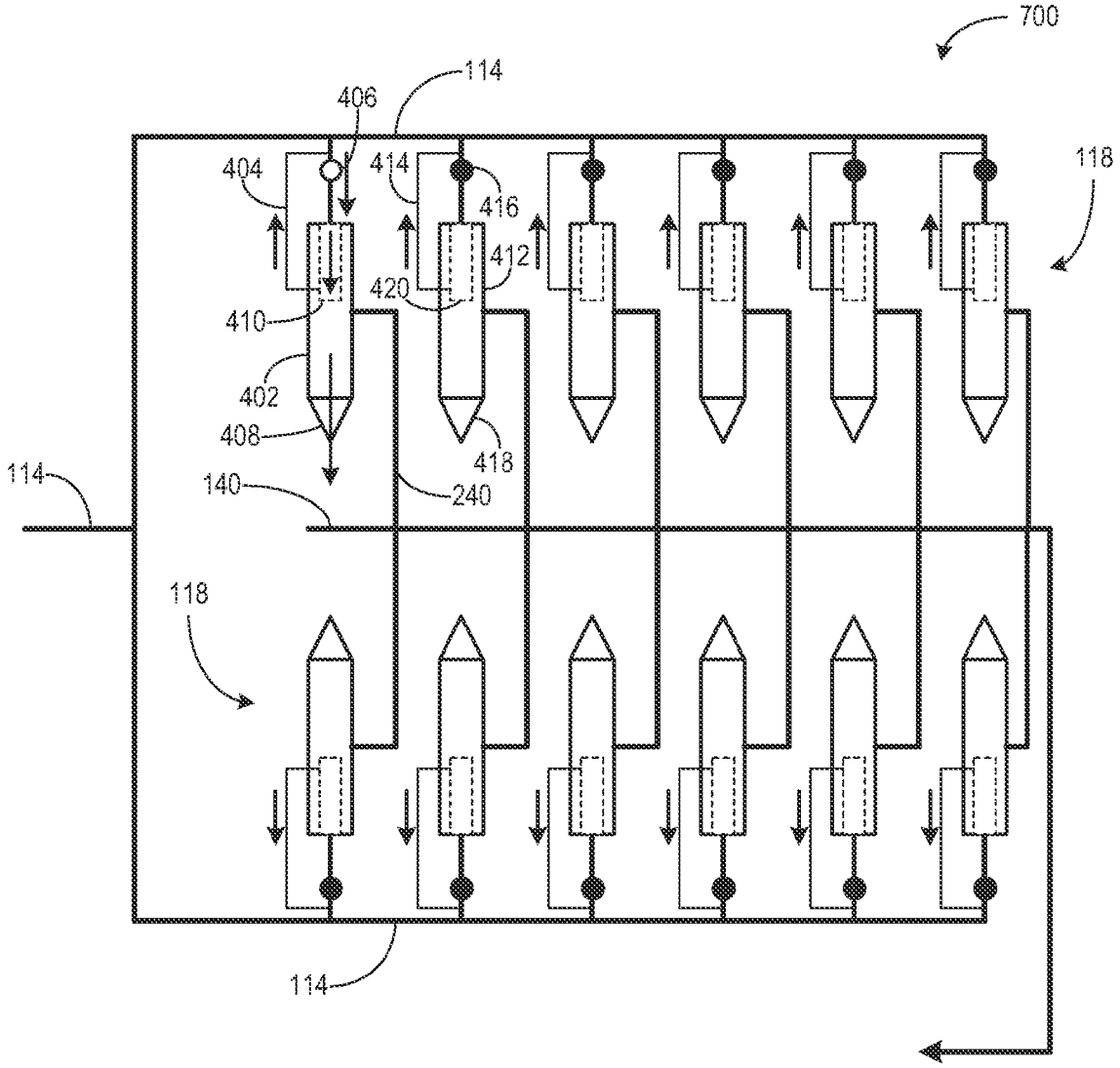
FIG. 7 shows a common rail fuel system with flow limiter valves upstream of fuel injectors according to an embodiment of the invention.

The following description relates to various embodiments of a leakage passageway for a fuel injector of a common rail fuel system. An example common rail fuel system including a common fuel rail and a plurality of fuel injectors is shown at FIG. 1. FIGS. 2-3 show an example fuel injector included in the common fuel rail system. Each fuel injector has an associated injector flow limiter valve, an injector accumulator, an injector body, and a nozzle. The injector flow limiter valve may reduce over fueling by closing during non-injection invents, thereby cutting off fluid communication between the injector accumulator and the common fuel rail. Example positions of one type of injector flow limiter valve are shown in FIG. 6. In one example, as shown at FIG. 3, a leakage passageway is coupled between an inlet of the injector flow limiter valve and the injector accumulator. As such, even during non-injection events, the injector accumulator is in fluid communication with the common fuel rail and the injector accumulators of all the other fuel injectors in the common rail fuel system. FIG. 4 and FIG. 7 show an example fuel injection event in a common rail fuel system with 12 fuel injectors. FIG. 5 presents a method for operating the fuel injectors during fuel injection events. During injection with a first fuel injector, all the flow limiter valves of the other fuel injectors may be closed. However, all the injector accumulators of all the fuel injectors (including the first fuel injector) are in fluid communication through all the leakage passageways of the fuel injectors. In this way, a fuel volume of the common fuel rail may increase, thereby reducing pressure fluctuations during injection events. Reduced fuel rail pressure amplitude (e.g., pressure fluctuations) may reduce wear on components of the common rail fuel system, thereby increasing a life of the components.

The approach described herein may be employed in a variety of engine types, and a variety of engine-driven systems. Some of these systems may be stationary, while others may be on semi-mobile or mobile platforms. Semi-mobile platforms may be relocated between operational periods, such as mounted on flatbed trailers. Mobile platforms include self-propelled vehicles. Such vehicles can include on-road transportation vehicles, as well as mining equipment, marine vessels, rail vehicles, and other off-highway vehicles (OHV). For clarity of illustration, a locomotive is provided as an example of a mobile platform supporting a system incorporating an embodiment of the invention.

Before further discussion of a leakage passageway for a fuel injector, an example of a fuel system for an engine is disclosed. For example, FIG. 1 shows a block diagram of a common rail fuel system (CRS) 100 for an engine of a vehicle, such as a rail vehicle. Liquid fuel is sourced or stored in a fuel tank 102. A low-pressure fuel pump 104 is in fluid communication with the fuel tank 102. In the embodiment shown in FIG. 1, the low-pressure fuel pump 104 is disposed inside of the fuel tank 102 and can be immersed below the liquid fuel level. In alternative embodiments, the low-pressure fuel pump may be coupled to the outside of the fuel tank and pump fuel through a suction device. Operation of the low-pressure fuel pump 104 is regulated by a controller 106.

Liquid fuel is pumped by the low-pressure fuel pump 104 from the fuel tank 102 to a high-pressure fuel pump 108 through a conduit 110. A valve 112 is disposed in the conduit 110 and regulates fuel flow through the conduit 110. For example, the valve 112 is an inlet metering valve (IMV). The IMV 112 is disposed upstream of the high-pressure fuel pump 108 to adjust a flow rate of fuel that is provided to the high-pressure fuel pump 108 and further to a common fuel rail 114 for distribution to a plurality of fuel injectors 118 for fuel injection. For example, the IMV 112 may be a solenoid valve, opening and closing of which is regulated by the controller 106. In other words, the controller 106 commands the IMV to be fully closed, fully open, or a position in between fully closed and fully opened in order to control fuel flow to the high-pressure fuel pump 108 to a commanded fuel flow rate. During operation of the vehicle, the IMV 112 is adjusted to meter fuel based on operating conditions, and during at least some conditions may be at least partially open. It is to be understood that the valve is merely one example of a control device for metering fuel and any suitable control element may be employed without departing from the scope of this disclosure. For example, a position or state of the IMV may be electrically controlled by controlling an IMV electrical current. As another example, a position or state of the IMV may be mechanically controlled by controlling a servo motor that adjusts the IMV.

The high-pressure fuel pump 108 increases fuel pressure from a lower pressure to a higher pressure. The high-pressure fuel pump 108 is fluidly coupled with the common fuel rail 114. The high-pressure fuel pump 108 delivers fuel to the common fuel rail 114 through a conduit 116. A plurality of fuel injectors 118 are in fluid communication with the common fuel rail 114. Each of the plurality of fuel injectors 118 delivers fuel to one of a plurality of engine cylinders 120 in an engine 122. Fuel is combusted in the plurality of engine cylinders 120 to provide power to the vehicle through an alternator and traction motors, for example. Operation of the plurality of fuel injectors 118 is regulated by the controller 106. In the embodiment of FIG. 1, the engine 122 includes four fuel injectors and four engine cylinders. In alternate embodiments, more or fewer fuel injectors and engine cylinders can be included in the engine.

Excess fuel in the fuel injectors 118 returns to the fuel tank 102 via a common fuel return 140. As such, the common fuel return 140 is coupled to the fuel tank 102. In one example, each fuel injector 118 has a fuel passage for returning fuel to the common fuel return 140, as shown at FIG. 2 and FIG. 4 and described further below. In other embodiments, the CRS 100 may not include a common fuel return 140.

Fuel pumped from the fuel tank 102 to an inlet of the IMV 112 by the low-pressure fuel pump 104 may operate at what is referred to as a lower fuel pressure or engine fuel pressure. Correspondingly, components of the CRS 100 which are upstream of the high-pressure fuel pump 108 operate in the lower fuel pressure or engine fuel pressure region. On the other hand, the high-pressure fuel pump 108 may pump fuel from the lower fuel pressure to a higher fuel pressure or rail fuel pressure. Correspondingly, components of the CRS 100 which are downstream of the high-pressure fuel pump 108 are in a higher-fuel pressure or rail fuel pressure region of the CRS 100.

A fuel pressure in the lower fuel pressure region is measured by a pressure sensor 126 that is positioned in the conduit 110. The pressure sensor 126 sends a pressure signal to the controller 106. In an alternative application, the pressure sensor 126 is in fluid communication with an outlet of the low-pressure fuel pump 104. A fuel temperature in the lower fuel pressure region is measured by a temperature sensor 128 that is positioned in conduit 110. The temperature sensor 128 sends a temperature signal to the controller 106.

A fuel pressure in the higher fuel pressure region is measured by a pressure sensor 130 that is positioned in the conduit 116. The pressure sensor 130 sends a pressure signal to the controller 106. The controller 106 uses this pressure signal to determine a rail pressure of fuel (e.g., FRP) in the common fuel rail. As such, the fuel rail pressure (FRP) is provided to the controller 106 by the pressure sensor 130. In an alternative application, the pressure sensor 130 is in fluid communication with an outlet of the high-pressure fuel pump 108. Note that in some applications various operating parameters may be generally determined or derived indirectly in addition to or as opposed to being measured directly.

In addition to the sensors mentioned above, the controller 106 receives various signals from a plurality of engine sensors 134 coupled to the engine 122 that may be used for assessment of fuel control health and associated engine operation. For example, the controller 106 receives sensor signals and then, based on these signals, determines one or more of air-fuel ratio, engine speed, engine load, engine temperature, ambient temperature, fuel value, a number of cylinders actively combusting fuel, and the like. In the illustrated implementation, the controller 106 is a computing device, such as microcomputer that includes a processor unit 136, non-transitory computer-readable storage medium device 138, input/output ports, memory, and a data bus. The computer-readable storage medium 138 included in the controller 106 is programmable with computer readable data representing instructions executable by the processor for performing the control routines and methods described below as well as other variants that are not specifically listed.

The controller 106 is operable to adjust various actuators in the CRS 100 based on different operating parameters received or derived from different signals received from the various sensors, to dynamically assess the health of the CRS and control operation of the engine based on the assessment. For example, in an embodiment, the controller 106 is operable to adjust fuel injection to the engine. Specifically, the controller may adjust fuel injection timing of one or more fuel injectors based on a determined injector activation time.

FIGS. 2-3 show an example fuel injector 118 of a common rail fuel system, such as the common rail fuel system depicted in FIG. 1. FIG. 2 shows the fuel injector 118 with an injector flow limiter valve 202 and an injector accumulator 204. FIG. 3 shows a magnified view of the injector flow limiter valve 202 of the fuel injector 118.

As shown in FIG. 2, the fuel injector 118 is coupled at a first end to a common fuel rail 114. The first end of the fuel injector 118 is proximate to the injector flow limiter valve 202. Additionally, a mounting flange 222 and collar 220 of the fuel injector 118 are proximate to the first end of the fuel injector 118. In one example, the mounting flange 222 connects to a damper (not shown) of the common rail fuel system. In other embodiments, the fuel injector 118 may not include a collar 220 or mounting flange 222. Instead, the fuel injector 118 may include other means of being coupled to the respective engine cylinder and mounted within the engine.

At a second end of the fuel injector 118, the fuel injector 118 injects fuel into an engine cylinder via a nozzle 208 of the fuel injector 118. The nozzle 208 of the fuel injector 118 includes a nozzle orifice 210 from where fuel is injected. The nozzle 208 further includes a nozzle needle 212. A valve 214, positioned proximate to the nozzle 208, controls injection of fuel via the nozzle needle 212 and through the nozzle orifice 210. A connecting line 218 is coupled to the valve 214 and triggers an actuator of the valve 214. The connecting line 218 is in communication with a controller (such as controller 106 shown in FIG. 1). Thus, in one example, the connecting line 218 is electrically coupled to the controller. As a result, the controller may actuate the fuel injector 118 to inject fuel through the nozzle orifice 210 via connecting line 218. Additionally, as shown in FIG. 2, the connecting line 218 passes through an injector body 206 of the fuel injector 118.

The injector accumulator 204 is coupled between the injector flow limiter valve 202 and the injector body 206. The injector body 206 is positioned upstream, with respect to a direction of fuel flow out of the fuel injector 118, of the valve 214 and the nozzle 208. The injector body 206 includes an injector fuel return passage 240. As described above with reference to FIG. 1, the injector fuel return passage 240 is coupled to a common fuel return coupled to a fuel tank. The injector fuel return passage 240 may also be referred to as a low-pressure fuel passage. As shown in FIG. 2, the injector fuel return passage 240 is positioned downstream of the leakage passageway 230. In some embodiments, the fuel return passage 240 may be positioned upstream or downstream of where it is shown coupled to the injector body 206 in FIG. 2. In other embodiments, the CRS may not include a common fuel return. Instead, each fuel injector may include an individual fuel return to the fuel tank. In yet another embodiment, the fuel injector may not include an injector fuel return passage 240 and the CRS may not include a common fuel return. As such, fuel may not be returned from the fuel injectors to the fuel tank.

The injector body 206 includes a high pressure fuel passage 216 coupled between the injector accumulator 204 and the nozzle 208. As such, fuel may flow through the injector accumulator 204 and into the high pressure fuel passage 216. Fuel for injection accumulates within the injector accumulator 204. Thus, as shown in FIG. 2, the injector accumulator 204 is an accumulation chamber or passage of the fuel injector 118. Fuel enters the injector accumulator 204 through the injector flow limiter valve 202, as shown in greater detail in FIG. 3. Further, the fuel injector 118 includes a leakage passageway 230 bypassing the flow limiter valve 202. The leakage passageway 230 is described in greater detail below, with reference to FIG. 3.

FIG. 3 shows a magnified view of a first end portion 300 (e.g., head portion) of the fuel injector 118 including the injector flow limiter valve 202. The injector flow limiter valve 202 includes an inlet 302 and an outlet 304. The inlet 302 is an upstream, first end and the outlet 304 is a downstream, second end of the injector flow limiter valve 202. The inlet 304 of the injector flow limiter valve 202 is coupled to the common fuel rail 114. As such, fuel traveling along the common fuel rail 114 enters the fuel injector 118 through the inlet of the injector flow limiter valve 202. In one example, the inlet 304 of the injector flow limiter valve 202 is directly coupled to the common fuel rail 114 with no intervening elements.

The injector flow limiter valve 202 includes a flow passage 306. The flow passage 306 may be referred to as a first passage of the fuel injector 118. In one example, the first passage is coupled between the common fuel rail 114 and the injector accumulator 204. The injector flow limiter valve includes a valve mechanism movable between an open and a closed position.

As shown in FIGS. 2-3, the injector flow limiter valve 202 is a passive ball and spring type valve. In this arrangement, a pressure drop across the valve determines the position of the valve. FIG. 6 shows three positions of the passive ball and spring type flow limiter valve. The valve includes a ball 608, a spring 610, and the flow passage 306. A resting position of the injector flow limiter valve 202 is shown at 602. In the resting position, the ball 608 is positioned (e.g., sealed) against an upstream end stop 612 of the injector flow limiter valve 202. In the resting position, little or no fuel flows through the flow passage 306 since a pressure against the ball 608 may be lower than required to open the valve.

An open position of the injector flow limiter valve 202 is shown at 604. In the open position, the ball 608 is positioned between the upstream end stop 612 and a downstream end stop 614 of the injector flow limiter valve 202 without blocking flow through the flow passage 306. Said another way, in the open position, the ball 608 does not seal against the upstream end stop 612 or the downstream end stop 614. As a result, fuel 612 flows into the flow passage 306, past the ball 608, and through the remainder of the flow passage 306 to downstream components of the fuel injector. For example, a pressure drop across the valve greater than a lower threshold pressure moves the ball 608 of the injector flow limiter valve 202 from the resting position (shown at 602) to the open position (shown at 604).

An amount of opening of the injector flow limiter valve 202 may be based on an amount of pressure drop (above the lower threshold pressure) across the ball 608. If the pressure drop across the ball 608 exceeds an upper pressure threshold, the spring 610 may be completely depressed such that the ball contacts the downstream end stop 614, as shown at 606. In some examples, when the ball contacts the downstream end stop 614, no additional fuel 612 may pass through the flow limiter valve 202 to enter the injector accumulator 204. Thus, the position at 606 wherein the ball 608 contacts the downstream end stop 614 may be referred to herein as the closed position. Then, when the pressure drop decreases below the lower threshold pressure, the ball moves back into the resting position wherein the spring 610 is compressed less than in the open or closed positions. As described above, the passive ball and spring type valve may actually have two types of closed position: the resting position and the closed position. Both the resting and closed positions shown at 602 and 604, respectively, may be referred to herein as closed positions since no flow may enter the injector flow limiter valve in these positions.

In an alternate embodiment, the injector flow limiter valve 202 may include another type of passive valve mechanism movable between an open and a closed position, such as a cylinder type valve. In yet another embodiment, the injector flow limiter valve 202 may be an actively controlled valve wherein a controller (e.g., controller 106 shown in FIG. 1) moves the valve between the open and closed positions.

In a closed position, no fuel enters the fuel injector 118 through the injector flow limiter valve 202. Alternatively, in an open position, fuel enters the fuel injector 118 through the injector flow limiter valve 202. Thus, the injector flow limiter valve 202 is configured to have a closed position blocking fuel flow through the flow passage 306. Further, the flow limiter valve 202 is configured to have an open position providing fluid communication with the common fuel rail 114 through the flow passage 306. As described further below with reference to FIG. 5, the position of the injector flow limiter valve 202 is controlled based on CRS conditions such as pressures in the CRS and whether or not the injector is injecting fuel. In one embodiment, a controller (such as controller 106 shown in FIG. 1) controls the position of the injector flow limiter valve 202. For example, the controller may open the injector flow limiter valve 202 to inject fuel with the fuel injector 118.

Then, when the fuel injector 118 is not injecting, the controller may close or maintain the injector flow limiter valve 202 closed.

The outlet 304 of the injector flow limiter valve 202 is coupled to the injector accumulator 204. In one example the outlet 304 of the injector flow limiter valve 202 is directly coupled to the injector accumulator 204 with nothing in between. The injector accumulator 204 includes an inner flow passage 308. Fuel flows through the inner flow passage 308 and to the high pressure fuel passage (shown in FIG. 2). Thus, the inner flow passage 308 of the injector accumulator 204 is coupled between the outlet 304 of the injector flow limiter valve 202 and the high pressure fuel passage. Further, the injector accumulator 204 includes an inner surface and an outer surface. The inner surface defines a circumference of the inner flow passage 308.

Additionally, the fuel injector 118 includes a leakage passageway 230 coupled between the injector accumulator 204 and the inlet 302 of the injector flow limiter valve 202. The leakage passageway 230 is different than the flow passage of the injector flow limiter valve 202. Specifically, an inlet, or first end, of the leakage passageway 230 is coupled to the inner flow passage 308 of the injector accumulator 204. An outlet, or second end, of the leakage passageway 230 is coupled to the inlet 302 of the injector flow limiter valve 202. Thus, the leakage passageway 230 bypasses the injector flow limiter valve 202. In one example, the first end of the leakage passageway 230 is directly coupled to the inner flow passage 308, with nothing in between, and the second end of the leakage passageway 230 is directly coupled to the inlet 302 of the injector flow limiter valve 202 with nothing in between. Additionally, as shown in FIG. 3, the leakage passageway 230 is parallel to the flow passage 306 of the injector flow limiter valve 202. The leakage passageway 230 may be referred to as a second passage of the fuel injector 118.

In another embodiment, the inlet of the leakage passageway 230 may be coupled to the outlet 304 of the injector flow limiter valve 202 instead of the inner flow passage 308 of the injector accumulator 204. In yet another embodiment, the outlet of the leakage passageway 230 may be coupled directly to the common fuel rail 114 instead of the inlet 302 of the injector flow limiter valve 202. In all the above-described embodiments, the leakage passageway 230 bypasses the injector flow limiter valve 202 and allows fluid communication between the injector accumulator 204 and the common fuel rail 114.

In one example, the leakage passageway 230 has a diameter within a range of 0.2-0.4 mm. In another example, the leakage passageway 230 has a diameter smaller than 0.2 mm or larger than 0.4 mm. The diameter of the leakage passageway 230 is based on a diameter which allows fluid communication between the injector accumulator 204 and the common fuel rail 114 without counteracting the injector flow limiter valve 202 and causing over fueling. For example, when the injector flow limiter valve 202 is in the closed position, fuel may still flow through the leakage passageway 230, thereby allowing fluid communication between the injector accumulator 204 and the rest of the common rail fuel system, including the common fuel rail 114 and the injector accumulators of the other fuel injectors in the system.

Additionally, as shown in FIG. 3, the flow limiter valve 202 is surrounded by the collar 220. Further, the mounting flange 222 is coupled to the collar and a portion of the outer surface of the injector accumulator 204. As shown in FIGS. 2-3, the flow passage 306 and the leakage passageway 230 are upstream of the nozzle 208 (e.g., injector nozzle) and the injector body 206. Further, the injector flow return passage 240 is downstream of the leakage passageway 230 and the flow passage 306.

The system of FIGS. 1-3 provide for a fuel injection system of an engine including a common fuel rail, a first fuel injector with a first leakage passageway coupled between a first injector accumulator and an inlet of a first injector flow limiter valve positioned in a first flow passage, the inlet of the first injector flow limiter valve coupled to the common fuel rail, and a second fuel injector with a second leakage passageway coupled between a second injector accumulator and an inlet of a second injector flow limiter valve positioned in a second flow passage, the inlet of the second injector flow limiter valve coupled to the common fuel rail.

The first injector accumulator is in fluid communication with the second injector accumulator through the first leakage passageway, the second leakage passageway, and the common fuel rail. In one example, when the first injector flow limiter valve is closed and the second injector flow limiter valve is open, the second injector accumulator is in fluid communication with the common fuel rail through the second flow passage and the second leakage passageway and the second injector accumulator is in fluid communication with the first injector accumulator through the first leakage passageway.

The fuel injection further includes a third fuel injector with a third leakage passageway coupled between a third injector accumulator and an inlet of a third injector flow limiter valve positioned in a third flow passage, the inlet of the third injector flow limiter valve coupled to the common fuel rail. The first injector accumulator, the second injector accumulator, and the third injector accumulator are all in fluid communication with one another through the first leakage passageway, the second leakage passageway, and the third leakage passageway, independent of a position of the first injector flow limiter valve, a position of the second injector flow limiter valve, and a position of the third injector flow limiter valve. The fuel injection system further includes a common fuel return coupled to a first injector return passage of the first fuel injector, a second injector return passage of the second fuel injector, and a third injector return passage of the third fuel injector.

Turning now to FIG. 4, a schematic 400 is shown of a plurality of fuel injectors 118 included in a common rail fuel system. Specifically, the schematic 400 shows twelve fuel injectors 118 coupled to a common fuel rail 114 and a common fuel return 140. The twelve fuel injectors 118 are split up into two banks of six fuel injectors 118. In other embodiments, the common rail fuel system may include more or less than twelve fuel injectors 118. In the example shown in FIG. 4, each fuel injector 118 injects fuel in a corresponding engine cylinder (not shown). In alternate examples, there may only be one bank of cylinders and one bank of fuel injectors 118.

Fuel flows from a common rail fuel system (such as the common rail fuel system shown in FIG. 1) to each fuel injector 118 via the common fuel rail 114. Each fuel injector 118 includes an injector flow limiter valve, an injector accumulator, a leakage passageway, and a nozzle, as shown at FIGS. 2-3. Each injector flow limiter valve of each fuel injector is in either an open or closed position. As shown in FIG. 4, the open position is depicted by an open circle and the closed position is depicted by a solid black circle.

Specifically, FIG. 4 shows a first fuel injector 402 with a first leakage passageway 404, a first injector flow limiter valve 406, and a first injector nozzle 408. The first leakage passageway 404 is coupled between an inlet of the first flow limiter valve 406 and a first injector accumulator 410 of the first fuel injector 402. The first injector flow limiter valve 406 is in the open position. In one example wherein the injector flow limiter valves are passively controlled, the first injector flow limiter valve 406 is in the open position due to the pressure drop across the valve being between a lower threshold pressure and an upper threshold pressure. As described further below, in an alternate example, the injector flow limiter valves may be actively controlled and the controller may open the first injector flow limiter valve 406 in order to inject fuel from the first fuel injector 402 and into a corresponding engine cylinder. Fuel flows from the common fuel rail 114, through the open first injector flow limiter valve 406, through the first injector accumulator 410, and out the first nozzle 408. As shown in FIG. 4, fuel is also able to flow through the first leakage passageway 404 from the first injector accumulator 410 to the inlet of the first injector flow limiter valve 406. Since the inlet of the first injector flow limiter valve 406 is coupled to the common fuel rail 114, the first leakage passageway enables fluid communication between the first injector accumulator 410 and the common fuel rail 114. Additionally, the first injector accumulator 410 is in fluid communication with the common fuel rail 114 through the flow passage of the first injector flow limiter valve 406.

During the injection event shown in FIG. 4 wherein the first fuel injector 402 is injecting fuel, all the other fuel injectors 118 are not injecting fuel. As such, the injector flow limiter valves of all the other fuel injectors (e.g., all fuel injectors 118 except the first fuel injector 402) are closed. The injector flow limiter valves of the other fuel injectors are in the closed position. In one example, the injector flow limiter valves of the other fuel injectors may be in the closed position because the pressure drop across the injector flow limiter valves is lower than the lower threshold pressure (e.g., the injector flow limiter valves are in a resting position). In alternate examples, not all of the injector flow limiter valves of the non-injecting fuel injectors may be closed. For example, there may be some temporal overlap wherein multiple flow limiter valves are simultaneously open based upon system design (e.g., engine speed, injection duration, number of injectors, etc.). However, at least some of the flow limiter valves of the non-injecting fuel injectors may be closed during injection with the first fuel injector 402.

For example, FIG. 4 shows a second fuel injector 412 with a second leakage passageway 414, a second injector flow limiter valve 416, a second nozzle 418, and a second injector accumulator 420. The second fuel injector flow limiter valve 416 is in a closed position and no fuel is being injected from the second fuel injector 412. As a result, no fuel enters the second fuel injector 412 through the flow passage of the second injector flow limiter valve 416. However, the second injector accumulator 420 is in fluid communication with the common fuel rail 114 and the first injector accumulator 410 through the second leakage passageway 414 of the second fuel injector 412.

In this way, the first injector accumulator 410 is in fluid communication with the second injector accumulator 420 through the first leakage passageway 404, the second leakage passageway 414, and the common fuel rail 114. Similarly, as shown in FIG. 4, a third fuel injector, a fourth fuel injector, and all the remaining fuel injectors of the twelve fuel injectors 118 include similar components as described above. During injection with the first fuel injector 402, all the injector flow limiter valves of the remaining fuel injectors are closed. However, the injector accumulators of each fuel injector 118, including the first fuel injector 402 and the second fuel injector 412, are in fluid communication with one another via each corresponding leakage passageway and the common fuel rail 114. As a result, a total volume of the common rail includes the volume of the common rail passages (e.g., common fuel rail 114 and common fuel return 140), the volume of each injector accumulator (e.g., 12 injector accumulator volumes in the example shown in FIG. 4), and the volume of each leakage passageway (e.g., 12 leakage passageway volumes in the example shown in FIG. 4). Further, in some embodiments, the common fuel rail 114 may include or be coupled to a common rail accumulator. The volume of the common rail accumulator is then also included in the total volume of the common rail.

By coupling the injector accumulators to one another via leakage passageways coupled to the common fuel rail 114, the volume of the common rail system increases. This increase in volume results in a decrease in pressure fluctuations, or pressure amplitude, of the common rail system during engine operation. Said another way, the leakage passageways may increase the total fuel volume of the common rail fuel system and dampen the pressure fluctuations. For example, a change in pressure amplitude during an injection event may be smaller in a common rail fuel system including fuel injectors with leakage passageways than a common rail fuel system including fuel injectors without leakage passageways. Specifically, if the flow injectors do not include leakage passageways, the injector accumulators of fuel injectors with closed injector flow limiter valves are isolated from the rest of the common rail fuel system. This may decrease the effective fuel volume (e.g., available fuel volume) of the system, thereby resulting in larger pressure fluctuations.

However, by fluidically coupling the injector accumulator volumes with the leakage passageways, the fuel rail pressure amplitude may be reduced. As a result, a desired fuel rail pressure may be maintained with smaller fluctuations. Additionally, reduced pressure amplitudes may decrease degradation of the common rail fuel system components.

In an alternate embodiment, the injector flow limiter valves may be positioned upstream of the fuel injectors instead of within the fuel injectors. For example, an injector flow limiter valve may be positioned in the common fuel rail, upstream of a corresponding fuel injector, as shown in FIG. 7. In some embodiments, the injector flow limiter valves may also be referred to as flow limiter valves.

FIG. 7 shows a first fuel injector 402 with a first injector flow limiter valve 406 positioned in a high pressure fuel line, the high pressure fuel line coupled to the common fuel rail 114. Specifically, an inlet of the first injector flow limiter valve 406 is coupled to the common fuel rail 114. In some examples, the first injector flow limiter valve 406 may be coupled directly between the common fuel rail 114 and an inlet of the first fuel injector 402. Thus, in this case, an outlet of the first injector flow limiter valve 406 is coupled directly to the inlet of the first fuel injector 402. As referred to herein, a components being directly coupled to another component means there are no additional components positioned between the directly coupled components.

As shown in FIG. 7, the first injector accumulator 410 is positioned proximate to the inlet of the first fuel injector 402, upstream of the first injector nozzle 408. The first leakage passageway is then coupled between the first injector accumulator 410 and the inlet of the injector flow limiter valve 406, the inlet coupled to the common fuel rail 114. FIG. 7 has common components as described above with reference to FIG. 4. As such, the common rail system shown in FIG. 7 may operate similarly to the common rail system of FIG. 4, described above.

In yet another embodiment, a single flow limiter valve may be positioned upstream of multiple fuel injectors. For example, a first flow limiter valve may be positioned in the common fuel rail, upstream of a first bank of fuel injectors. A second flow limiter valve may then be positioned in the common fuel rail, upstream of a second bank of fuel injectors. A first leakage passageway may then be coupled between a position on the common fuel rail upstream of the first flow limiter valve and a position on the common fuel rail downstream of the first flow limiter valve. A second leakage passageway may then be coupled between a position on the common fuel rail upstream of the second flow limiter valve and a position on the common fuel rail downstream of the second flow limiter valve. Alternatively, each fuel injector may include a leakage passageway coupled to a respective injector accumulator at a first end of the leakage passageway. A second end of the leakage passageway may then be coupled to the common fuel rail, upstream of the corresponding flow limiter valve.

FIG. 5 shows an example method 500 for operating fuel injectors during injection events. Portions or the entirety of method 500 may be executed using instructions stored on a controller, such as controller 106 shown in FIG. 1. The method may be performed in an engine and common rail fuel system including various numbers of engine cylinders and fuel injectors. As discussed below, during an injection event, one fuel injector injects fuel while all other fuel injectors are not injecting. As a result, only the injector flow limiter valve of the injecting fuel injector is opened while all other injector flow limiter valves of the remaining fuel injectors are closed. However, in alternate embodiments, not all of the other injector flow limiter valves may be closed. In this embodiment, at least one injector flow limiter valve is open while at least one injector flow limiter valve is closed, the open valve corresponding to the injecting fuel injector and the closed valve corresponding to a non-injecting fuel injector.

The method begins at 502 by estimating and/or measuring engine operating conditions. In one example, engine operating conditions include a fuel rail pressure, engine speed and load, a fuel pulse width signal, fuel volume, and the like. At 504, the method includes determining if there is a request to inject fuel with one or more of the fuel injectors, such as fuel injectors 118 shown in FIG. 4. For example, the request to inject fuel may include a request to inject fuel with a first fuel injector, such as the first fuel injector 402 shown in FIG. 4 and/or FIG. 7. In another example, the request to inject fuel may include a request to inject fuel with a second fuel injector, such as the second fuel injector 412 shown in FIG. 4 and/or FIG. 7. In yet another example, the request to inject fuel may include a request to inject fuel with another fuel injector. If there is no request to inject fuel, the controller maintains engine operation and does not inject fuel at 506. At 506, the injector flow limiter valves of all the fuel injectors may remain closed, or in a resting closed position.

In response to a request to inject fuel with a fuel injector, fuel may be delivered through the common rail at 507. The controller then opens the nozzle of the injecting fuel injector to inject fuel at 508. At 509, the flow limiter valve of the injecting fuel injector opens. In one example, the flow limiter valve of the injecting fuel injector opens passively due to the pressure drop across the flow limiter valve being between the lower threshold pressure and the upper threshold pressure. In another example, the controller opens the flow limiter valve of the injecting fuel injector if the flow limiter valves are actively controlled. As discussed above, the injecting fuel injector is the fuel injector requested to inject fuel. In one example, only one fuel injector may inject fuel at once. In this example, only the one injecting fuel injector may inject fuel. Accordingly, the remaining fuel injectors are non-injecting fuel injectors. In another example, more than one fuel injector injects fuel at once. In this example, more than one fuel injector is the injecting fuel injector.

At 510, the injector flow limiter valves of the non-injecting fuel injectors close. In one example, the flow limiter valves of the non-injecting fuel injectors close passively due to the pressure drop across the flow limiter valves being lower than the lower threshold pressure. In another example, the controller closes the flow limiter valves of the non-injecting fuel injectors at 510 if the flow limiter valves are actively controlled. When the injector flow limiter valves are closed, no fuel flows through the flow passages of the injector flow limiter valves. This is shown pictorially in FIG. 4 and FIG. 7 with the solid circles at the non-injecting fuel injectors.

At 512, the method includes injecting fuel with the injecting fuel injector. The method at 512 also includes not injecting fuel with the remaining, non-injecting fuel injectors. At 514, the method includes flowing fuel through the leakage passageways of all the fuel injectors, including the injecting and non-injecting fuel injectors, while injecting the fuel (e.g., during the injection event). In this way, even when a subset of the injector flow limiter valves are closed, the injector accumulators of all the fuel injectors in the common rail fuel system are fluidically coupled and in communication with one another through each of the leakage passageways of the fuel injectors and the common fuel rail. During any injection event, the volume of the common rail fuel system includes all the injector accumulators, all the leakage passageways, and the common fuel rail. As a result, fuel rail pressure fluctuations may decrease in amplitude over common rail fuel systems in which non-injecting fuel injectors are fluidically isolated from injecting fuel injectors and the rest of the common rail fuel system.

As one example of the method at FIG. 5, during a first injection event, a first injector flow limiter valve of a first fuel injector opens. Further, a first injector flow limiter valve of a first fuel injector opens and injects fuel while a second injector flow limiter valve of a second fuel injector remains closed. As described above, the method further includes flowing fuel through a first leakage passageway of the first fuel injector and through a second leakage passageway of the second fuel injector while injecting fuel with the first fuel injector.

As a second example of the method at FIG. 5, during a second injection event, the second injector flow limiter valve of the second fuel injector opens and injects fuel while the first injector flow limiter valve of the first fuel injector remains closed. The method further includes flowing fuel through the second leakage passageway of the second fuel injector and through the first leakage passageway of the first fuel injector while injecting fuel with the second fuel injector.

In this way, a leakage passageway disposed between an injector accumulator and an inlet of an injector flow limiter valve of a fuel injector increases fluid communication between the injector accumulator and a common fuel rail. Specifically, a plurality of fuel injectors may be coupled to the common fuel rail. Each of the plurality of fuel injectors may include an injector flow limiter valve, an injector accumulator, and a leakage passageway. With this system, all the injector accumulators of the plurality of fuel injectors are fluidically coupled to the common fuel rail and one another. Subsequently, the fluidic coupling of all of the injector accumulators increases the total fuel volume of the common rail. As a result, fuel rail pressure fluctuations during engine operation may be reduced. The smaller pressure fluctuations may, in turn, decrease degradation of the components of the common rail fuel system.

As one embodiment, a fuel injector comprises an injector accumulator, an injector flow limiter valve configured to control a flow of fuel from a common fuel rail and into the injector accumulator, and a leakage passageway coupled between the injector accumulator and an inlet of the injector flow limiter valve, the leakage passageway bypassing the injector flow limiter valve. The inlet of the injector flow limiter valve is fluidically coupled to the common fuel rail and the leakage passageway provides fluid communication between the injector accumulator and the common fuel rail. The fuel injector further includes a flow passage, different than the leakage passageway, coupled between the common fuel rail and the injector accumulator, the flow passage including the injector flow limiter valve. The injector flow limiter valve is configured to have a closed position blocking fuel flow through the flow passage. Additionally, the injector flow limiter valve is configured to have an open position providing fluid communication with the common fuel rail through the flow passage.

The flow passage and the leakage passageway are upstream of an injector nozzle and an injector body of the fuel injector, the injector body coupled to the injector accumulator. Additionally, the leakage passageway has a diameter of 0.2-0.4 mm.

In one example, an inlet of the leakage passageway is coupled to the injector accumulator and an outlet of the leakage passageway is coupled to the inlet of the injector flow limiter valve. In another example, an inlet of the leakage passageway is coupled to an outlet of the injector flow limiter valve, the outlet of the injector flow limiter valve fludically coupled to the injector accumulator, and an outlet of the leakage passageway is coupled to the inlet of the injector flow limiter valve.

As another embodiment, a fuel injector comprises an injector accumulator, a first passage coupled between a common fuel rail and the injector accumulator, an injector flow limiter valve positioned within the first passage, and a second passage, separate from the first passage, coupled between the injector accumulator and an inlet of the injector flow limiter valve, the inlet coupled to the common fuel rail.

The second passage bypasses the injector flow limiter valve. Further, the first passage and the second passage are parallel to one another. In one example, the second passage has a diameter of 0.2-0.4 mm and the second passage has an inlet coupled to the injector accumulator and an outlet coupled to the inlet of the injector flow limiter valve. The fuel injector further comprises a third passage, the third passage coupled to a common fuel return, the common fuel return coupled to a fuel tank.

As yet another embodiment, a fuel injector for an engine comprises an injector accumulator, a first passage coupled between a flow limiter valve and the injector accumulator, the flow limiter valve positioned in a high pressure fuel line, upstream of the fuel injector, the high pressure fuel line coupled to a common fuel rail, and a second passage, separate from the first passage, coupled between the injector accumulator and an inlet of the injector flow limiter valve, the inlet coupled to the common fuel rail. The second passage bypasses the injector flow limiter valve and has a diameter of 0.2-0.4 mm. Further, the second passage has an inlet coupled to the injector accumulator and an outlet coupled to the inlet of the injector flow limiter valve. The fuel injector further comprises a third passage, the third passage positioned downstream of the first passage and the second passage, in a direction of fuel flow through the fuel injector toward the nozzle, and the third passage coupled to a common fuel return, the common fuel return coupled to a fuel tank.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property. The terms "including" and "in which" are used as the plain-language equivalents of the respective terms "comprising" and "wherein." Moreover, the terms "first," "second," and "third," etc. are used merely as labels, and are not intended to impose numerical requirements or a particular positional order on their objects.

This written description uses examples to disclose the invention, including the best mode, and also to enable a person of ordinary skill in the relevant art to practice the invention, including making and using any devices or systems and performing any incorporated methods. The patentable scope of the invention is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

The invention claimed is:

1. A fuel injector for an engine, comprising:

an injector accumulator;

an injector flow limiter valve configured to control a flow of fuel from a common fuel rail and into the injector accumulator; and a leakage passageway coupled between the injector accumulator and an inlet of the injector flow limiter valve, the leakage passageway bypassing the injector flow limiter valve.

2. The fuel injector of claim 1, wherein the inlet of the injector flow limiter valve is fluidically coupled to the common fuel rail and wherein the leakage passageway provides fluid communication between the injector accumulator and the common fuel rail.

3. The fuel injector of claim 1, wherein the fuel injector includes a flow passage, different than the leakage passageway, coupled between the common fuel rail and the injector accumulator, the flow passage including the injector flow limiter valve.

4. The fuel injector of claim 3, wherein the injector flow limiter valve is configured to have a closed position blocking fuel flow through the flow passage.

5. The fuel injector of claim 3, wherein the injector flow limiter valve is configured to have an open position providing fluid communication with the common fuel rail through the flow passage.

6. The fuel injector of claim 3, wherein the flow passage and the leakage passageway are upstream of an injector nozzle and an injector body of the fuel injector, the injector body coupled to the injector accumulator.

7. The fuel injector of claim 1, wherein the leakage passageway has a diameter in a range of 0.2-0.4 mm.

8. The fuel injector of claim 1, wherein an inlet of the leakage passageway is coupled to the injector accumulator and an outlet of the leakage passageway is coupled to the inlet of the injector flow limiter valve.

9. The fuel injector of claim 1, wherein an inlet of the leakage passageway is coupled to an outlet of the injector flow limiter valve, the outlet of the injector flow limiter valve fludically coupled to the injector accumulator, and an outlet of the leakage passageway is coupled to the inlet of the injector flow limiter valve.

10. A fuel injector for an engine, comprising:

an injector accumulator;

a first passage coupled between a flow limiter valve and the injector accumulator, the flow limiter valve positioned in a high pressure fuel line, upstream of the fuel injector, the high pressure fuel line coupled to a common fuel rail; and a second passage, separate from the first passage, coupled between the injector accumulator and an inlet of the injector flow limiter valve, the inlet coupled to the common fuel rail.

11. The fuel injector of claim 10, wherein the second passage bypasses the injector flow limiter valve.

12. The fuel injector of claim 10, wherein the second passage has a diameter of 0.2-0.4 mm.

13. The fuel injector of claim 10, wherein the second passage has an inlet coupled to the injector accumulator and an outlet coupled to the inlet of the injector flow limiter valve.

14. The fuel injector of claim 10, further comprising a third passage, the third passage positioned downstream of the first passage and the second passage and the third passage coupled to a common fuel return, the common fuel return coupled to a fuel tank.

15. A fuel injection system of an engine, comprising:

a common fuel rail;

a first fuel injector with a first leakage passageway coupled between a first injector accumulator and an inlet of a first injector flow limiter valve positioned in a first flow passage, the inlet of the first injector flow limiter valve coupled to the common fuel rail; and a second fuel injector with a second leakage passageway coupled between a second injector accumulator and an inlet of a second injector flow limiter valve positioned in a second flow passage, the inlet of the second injector flow limiter valve coupled to the common fuel rail.

16. The fuel injection system of claim 15, wherein the first injector accumulator is in fluid communication with the second injector accumulator through the first leakage passageway, the second leakage passageway, and the common fuel rail.

17. The fuel injection system of claim 15, wherein when the first injector flow limiter valve is closed and the second injector flow limiter valve is open, the second injector accumulator is in fluid communication with the common fuel rail through the second flow passage and the second leakage passageway and the second injector accumulator is in fluid communication with the first injector accumulator through the first leakage passageway.

18. The fuel injection system of claim 15, further comprising a third fuel injector with a third leakage passageway coupled between a third injector accumulator and an inlet of a third injector flow limiter valve positioned in a third flow passage, the inlet of the third injector flow limiter valve coupled to the common fuel rail.

19. The fuel injection system of claim 18, wherein the first injector accumulator, the second injector accumulator, and the third injector accumulator are all in fluid communication with one another through the first leakage passageway, the second leakage passageway, and the third leakage passageway, independent of a position of the first injector flow limiter valve, a position of the second injector flow limiter valve, and a position of the third injector flow limiter valve.

20. The fuel injection system of claim 18, further comprising a common fuel return coupled to a first injector return passage of the first fuel injector, a second injector return passage of the second fuel injector, and a third injector return passage of the third fuel injector.

* * * * *